United States Patent [19]

Kisling et al.

[11] Patent Number: 4,767,264

[45] Date of Patent: Aug. 30, 1988

[54] VANE LEVER ARM CONSTRUCTION

[75] Inventors: Douglas L. Kisling, Palm Beach Gardens; John C. Jones, Jupiter, both of Fla.

[73] Assignee: United Technologies Corporation, Hartford, Conn.

[21] Appl. No.: 925,847

[22] Filed: Oct. 31, 1986

[51] Int. Cl.[4] ..... F04D 29/36

[52] U.S. Cl. ..... 415/156

[58] Field of Search ..... 415/156, 159, 148

[56] References Cited

U.S. PATENT DOCUMENTS

| | | | |
|---|---|---|---|
| 2,932,440 | 4/1960 | Hemsworth | 415/156 |
| 3,652,177 | 3/1972 | Loebel | 415/156 |
| 3,893,784 | 7/1975 | Zerlauth | 415/149 R |
| 4,668,165 | 5/1987 | Ludwick | 415/156 |

FOREIGN PATENT DOCUMENTS

| | | | |
|---|---|---|---|
| 743009 | 10/1943 | Fed. Rep. of Germany | 415/156 |
| 99147 | 4/1961 | Netherlands | 415/156 |

*Primary Examiner*—Robert E. Garrett
*Assistant Examiner*—John T. Kwon
*Attorney, Agent, or Firm*—Norman Friedland

[57] ABSTRACT

A vane lever arm for the variable stator/vane assembly of a gas turbine engine that is fabricated from sheet metal and has a flexible thin section to allow out of plane movement and a rigid thicker end for supporting the pin attached to the synchronous ring.

3 Claims, 5 Drawing Sheets

VANE LEVER ARM CONSTRUCTION

The invention was made under a Government contract and the Government has rights therein.

CROSS REFERENCE TO RELATED APPLICATION

This application constitutes an improvement over the construction of the vane lever arm disclosed in U.S. patent application Ser. No. 857,203 filed Apr. 29, 1986 by J. H. Castro and R. S. Thompson entitled STATOR VANE LINKAGE and assigned to United Technologies Corporation, the assignee common to this patent application.

TECHNICAL FIELD

This invention relates to gas turbine engines and particularly to the lever arm construction of the variable vane/stator assembly.

BACKGROUND ART

As is well known the variable vane/stator of a gas turbine engine serves to change the geometry of the engine and typically, serves to change the direction of the engine's working medium flowing from one compressor or turbine stage to the next.

The stator/vane assembly generally includes a mount rotatable about a radially oriented axis for each individual stator vane which is in turn, connected to a synchronizing (sync) ring. Such assemblies may use a plurality of lever arms to connect each individual mount to the sync ring so that movement of the sync ring will cause uniform movement to each individual vane/stator.

Actuation of the lever arm by the sinc ring results in out of plane rotation of the lever arm. This motion has been accommodated by several methods in prior designs, such as uniballs, sloppy pin and bushing and flexible arms. The flexible arm approach is considered superior from a joint wear and vane accuracy standpoint. However, the disadvantage of the flexible arm concept is eventual fatigue of the arm.

DISCLOSURE OF THE INVENTION

This invention provides a vane lever arm constructed from sheet metal having a thin intermediate portion of the arm permitting a twisting movement. The end for receiving the pin for connection to the sync ring is embossed for defining a thickened portion for receiving the pin through an opening therein. A feature of this invention is that the dimensions of the thinned intermediate portion and the thickened end for receiving the pin is judiciously selected to assure the proper twisting movement while increasing the fatigue life of the arm.

A feature of this invention is an improved lever arm for a variable stator/vane of a gas turbine engine characterized as being less expensive to fabricate and having increased durability.

The foregoing and other objects, features and advantages of the present invention will become more apparent in the light of the following detailed description of preferred embodiments thereof as illustrated in the accompanying drawing.

BEST MODE FOR CARRYING OUT THE INVENTION

Figure 1:
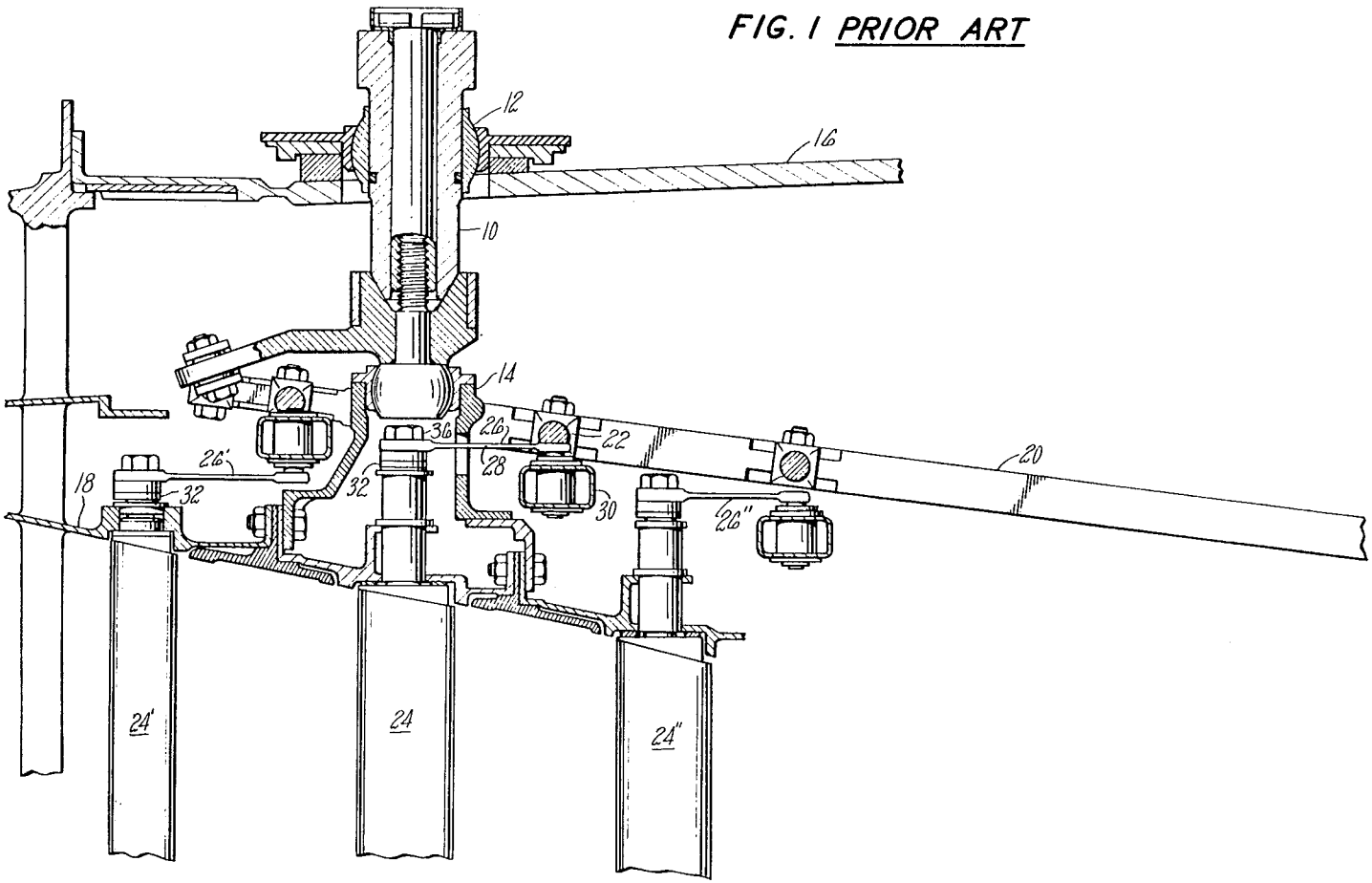
FIG. 1 PRIOR ART
FIG. 1 is a partial view, partly in section and partly in elevation showing a variable stator assembly representing the prior art.

This invention is best understood by first understanding the problems associated with the prior art design. Reference is made to FIG. 1 which shows the prior art assembly of a variable vane/stator of a gas turbine engine. An example of such as engine using such construction is the F100 engine manufactured by Pratt & Whitney Aircraft, a Division of United Technologies Corporation, the assignee of this patent application, and for more details, reference should be made thereto. For the sake of convenience and simplicity only such components that are necessary for an understanding of the invention will be shown and described. Suffice it to say that the turbine engine may include a fan section that ingests ambient air to be processed by the engine. A portion of the fan air is pressurized and accelerated by the fan for producing thrust. The remaining portion is fed to the core section comprising a compressor section, combustion section and turbine section which typically processses the air together with fuel to generate sufficient power to drive the fan and produce additional thrust in a well known manner. The variable stator vanes which are typically mounted in the compressor stages are synchronously varied so as to change the angle of attack of the engine's working medium as it is delivered to the next succeeding compressor blades.

As shown in FIG. 1, the prior art systems generally provide a radially oriented torque shaft 10 supported at the radially inward end by a span of spherical bearings 12 and 14, one being secured to the compressor case and the other secured to the fan duct in any suitable manner.

The torque shaft 10 is free to rotate about its longitudinal axis as well as to be deflected within its supporting bearings 12 and 14. Rotational motion is imparted to the torque shaft 10 by a laterally extending drive arm (not shown).

Rotational motion of the torque shaft 38 induced by a linear actuator (not shown) pivots the beam 20 driving the sync ring via the ring link 22. The circumferential sync ring rotates the stator vanes 24 of an individual stator stage via the linking vane arms 26.

As noted additional stages of stator vanes may be likewise varied by connecting additional sync rings to the beam 20 for like movement of the vane lever arm 26' and 26'' for rotational movement of vanes 24' and 24'' respectively. In the prior art construction the vane lever arm comprising casted arm 28 with an integral pin that attaches to the sync ring. A suitable pin 32 carried by each of the vanes 24 (one being shown) extends through on opening at the other end of vane lever arm 26 which may be secured thereto by nut 36.

Figure 3:
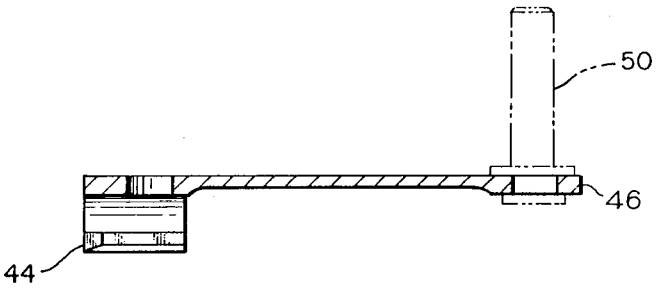
FIG. 3 is a sectional view taken along lines 3—3 of FIG. 2.
Figure 2:
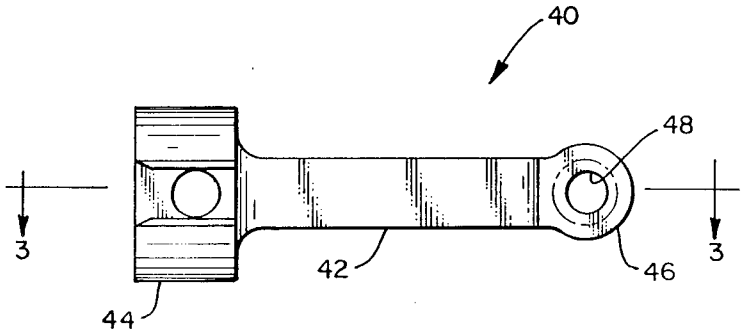
FIG. 2 is a plan view of the improved vane lever arm.
Figure 4:
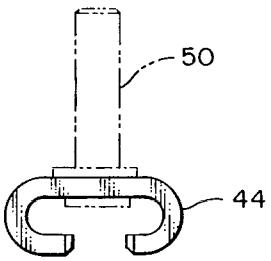
FIG. 4 is an end view of the lever arm of FIG. 2.

The lever arm generally indicated by reference numeral 40 shown in its preferred embodiment in FIGS. 2, 3, and 4 comprises a main portion 42, a retention clip 44 and an embossed end 46. The lever arm is fabricated from sheet metal as opposed to being cast as was done heretofore and has formed therein the retention clip 44. The retention clip 44 attaches to the individual vane and serves to assure that positive and accurate positioning of the vane will result upon activation of the sync ring. A swaged pin 50 (shown in phantom) is fitted through the opening 48 formed on the embossed end 46 to be secured to the sync ring.

According to this invention the main portion 42 of lever arm 40 is thinned to a predetermined dimension and the embossed end is thickened to a predetermined dimension as will be described in further detail hereinbelow. As was apparent from the foregoing, lever arm 40, which is one of a series, serves to connect each of the variable stators (or vanes) to the sync ring. As mentioned above, the positioning of the sync ring results in out of plane rotation of lever arm 40. This invention improves the fatigue life of the flexible lever arm by judiciously dimensioning the lever arm while allowing the arm to twist to accommodate the out of plane movement occasioned by the relative motion between the sync ring and vane.

Such a construction overcomes the heretofore known fatigue problems exhibited by other types of flexible connections, by eliminating or minimizing the stress concentration at the pin hole which resulted from the twisting movement when actuation took place. By virtue of this invention, the embossed area around the pin hole reinforces the hole, prevents twisting from occurring adjacent to the hole, and assures that twisting only occurs at the thin section of the arm. This effectively, relocates the high stress concentration at the hole, where there is a high propensity for fatigue, to the flat portion of the arm.

In addition, by virtue of this construction, the retention clip 44 can be made sufficiently thick to achieve a stiffer clip than would otherwise be achieveable if a uniform material thickness was utilized.

The next portion of this disclosure deals with the method of obtaining the proper thickness of the intermediate portion (thin) of the arm and the embossed portion (thick). Reference is now made to the charts in FIGS. 4, 5 and 6, which are plots of arm thickness vs. torsional stress.

Figure 5:
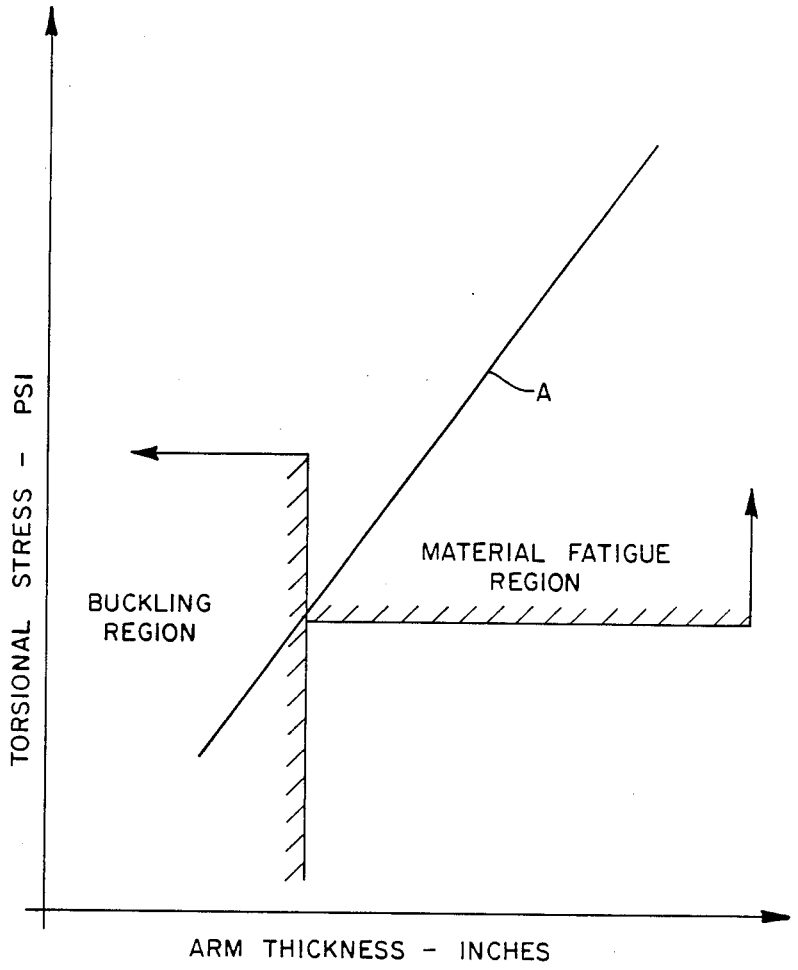
FIG. 5 is a graphical representation showing the relationship of the thickness of the lever arm to the torsional stress.

For a given set of geometric requirements such as sync ring diameter, stator slew angle and lever arm length, a line of arm stress vs. arm thickness can be drawn as noted in FIG. 5. Curve A shows that there is a direct proportion between torsional stress and thickness. As thickness increases, the stress in the arm increases. Minimum thickness of the arm is established by the requirement that the arm must not buckle under stator aerodynamic loads. Maximum thickness of the arm is set by the fatigue limit of the lever arm material.

Given certain geometric constraints, there is no lever arm thickness that satisfies both the buckling and fatigue requirements. Under these constraints, the solution is to reduce the thickness of the arm in the middle to reduce the stress at the hole. Thinning the arm has the effect of softening the arm, thereby reducing the torque induced at the pin to arm joint. The arm can be thinned until the buckling limit is reached or manufacturing capability limits the arm thickness.

Figure 6:
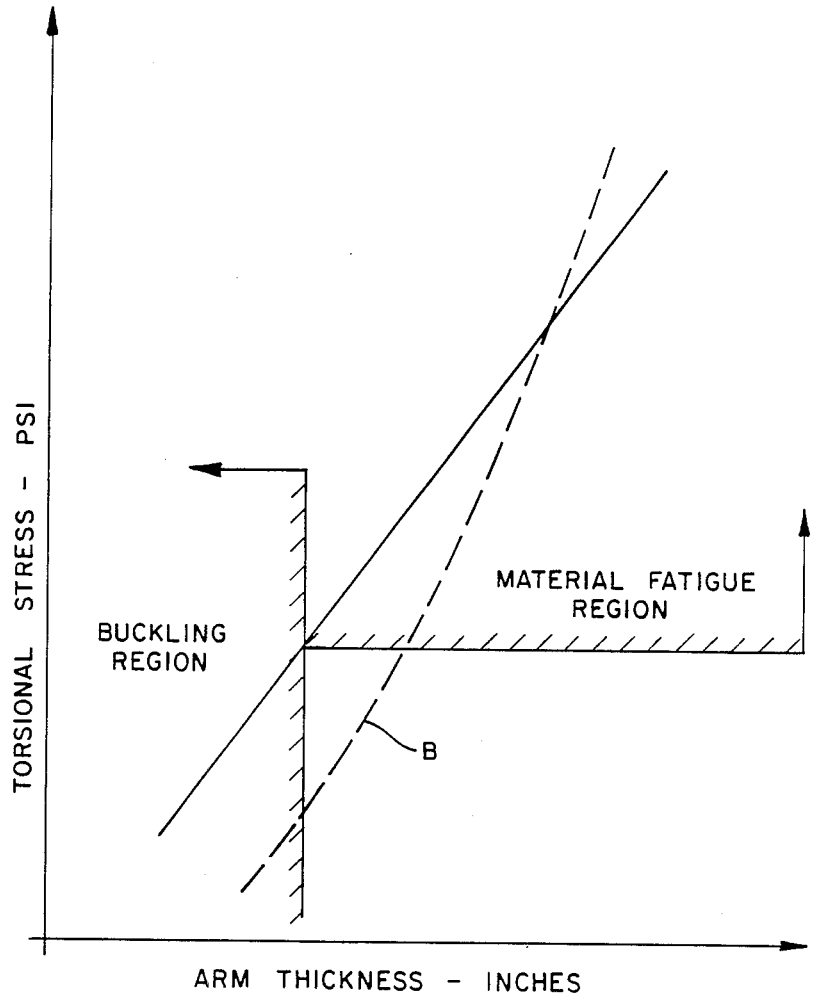
FIG. 6 is a peripheral representation showing the relationship of the lever arm thickness to the torsional stress when the mid section of the lever arm becomes thinner.
Figure 7:
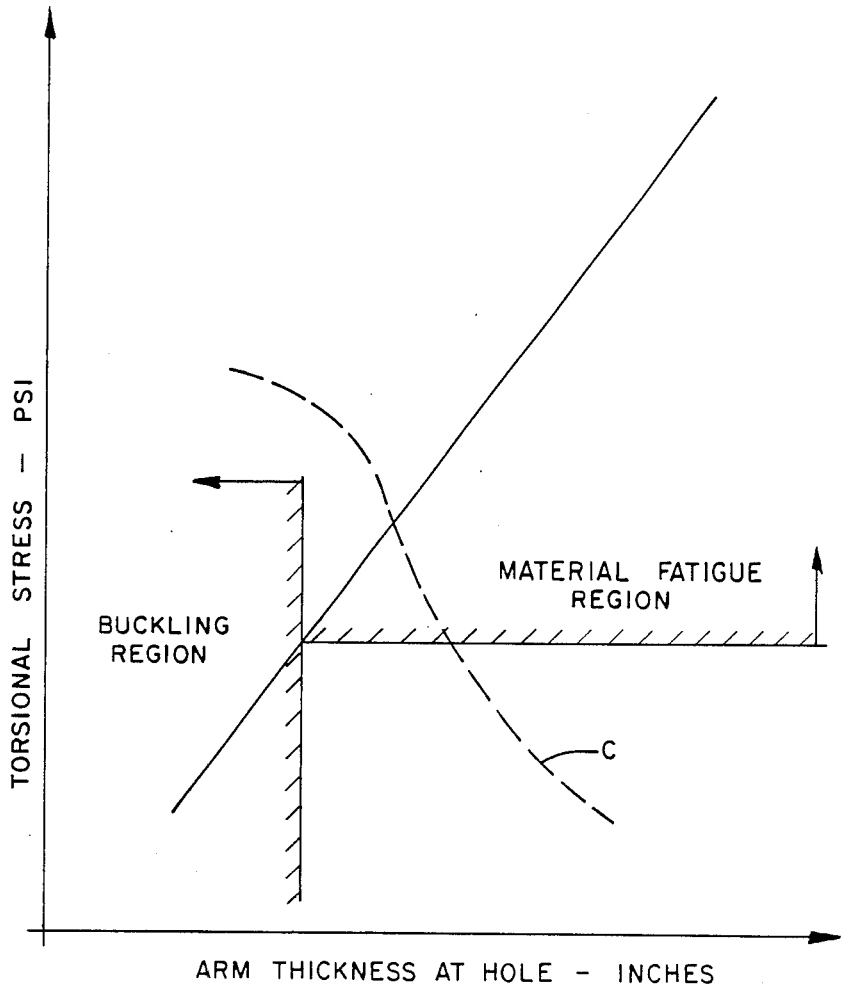
FIG. 7 is a graphical representation showing the relationship of the lever arm thickness to the torsional stress as the area around the hole is made thicker.

FIG. 6 shows the resulting stress vs. arm thickness at the limiting location on the part, the hole. Curve B demonstrates that even though the thickness at the hole is held constant, the stress at the hole can be reduced by thinning the arm away from the hole. Curve C in FIG. 7 shows a plot of stress at the hole as a function of thickness at the hole, keeping arm thickness constant. Hence, the thinness of the mid section of arm 42 is selected by measuring the torsional stress so that it is sufficient then to avoid falling in the buckling and fatigue regions. And likewise the embossed hole is of sufficient thickness that its torsional stress falls outside the buckling and fatigue regions.

It should be understood that the invention is not limited to the particular embodiments shown and described herein, but that various changes and modifications may be made without departing from the spirit and scope of this novel concept as defined by the following claims.

What is claimed is:

1. For a stator/vane assembly for a gas turbine engine, a synchronous ring for synchronous movement of each of a plurality of stator vanes mounted about a circumference, a lever arm connected to said synchronous ring and each of said stators or vanes comprising a generally flat rectangularly shaped arm having at least one end embossed to form a thickened portion and a relatively thin intermediate portion, said lever arm being made from sheet metal, said embossed end having an opening for receiving a pin for being attached to said synchronous ring and the dimensions of said embossment and said intermediate portion of said lever arm being selected to allow twisting of said lever arm at said intermediate portion and no twisting at said embossed end.

2. For a stator/vane assembly as claimed in claim 1 wherein the thickness of said embossed end is selected to exhibit a torsional stress value between the buckling region of said lever arm and the fatigue region of said sheet metal.

3. For a stator vane assembly as in claim 2 wherein the thinness of said intermediate portion is selected to exhibit a torsional stress value between the buckling region of said lever arm and the fatigue region of said sheet metal.

* * * * *

UNITED STATES PATENT AND TRADEMARK OFFICE

CERTIFICATE OF CORRECTION

PATENT NO. : 4,767,264

DATED : August 30, 1988

INVENTOR(S) : Douglas L. Kisling et al

It is certified that error appears in the above-identified patent and that said Letters Patent is hereby corrected as shown below:

Column 2, line 22: change "as" to --an--

Column 2, line 64: delete "comprising" and insert --is comprised of a--

Signed and Sealed this

Seventeenth Day of January, 1989

*Attest:*

DONALD J. QUIGG

*Attesting Officer*

*Commissioner of Patents and Trademarks*